United States Patent [19]

Dunlap et al.

[11] Patent Number: 4,571,911

[45] Date of Patent: Feb. 25, 1986

[54] MODULAR INSULATION ANCHOR

[75] Inventors: David R. Dunlap, Claremore; Eugene N. Brown, Broken Arrow, both of Okla.

[73] Assignee: Refractory Anchors, Inc., Broken Arrow, Okla.

[21] Appl. No.: 560,536

[22] Filed: Dec. 12, 1983

[51] Int. Cl.[4] ..... E04C 1/40

[52] U.S. Cl. ..... 52/509; 52/715

[58] Field of Search ..... 269/53; 110/336; 52/364, 365, 383, 385, 410, 506, 509, 513, 698, 699, 712–715, 766, 778

[56] References Cited

U.S. PATENT DOCUMENTS

| | | | |
|---|---|---|---|
| 3,031,044 | 4/1962 | Stitt et al. | 52/410 |
| 4,244,269 | 1/1981 | Gorell | 52/506 |
| 4,248,023 | 2/1981 | Dunlap | 52/506 |
| 4,478,022 | 10/1984 | Wilkinson et al. | 52/509 |

FOREIGN PATENT DOCUMENTS

| | | | |
|---|---|---|---|
| 1134496 | 8/1962 | Fed. Rep. of Germany | 52/506 |

*Primary Examiner*—John E. Murtagh
*Assistant Examiner*—Andrew Joseph Rudy
*Attorney, Agent, or Firm*—Head, Johnson & Stevenson

[57] ABSTRACT

An insulation supporting apparatus for use in attaching blankets of insulation to a surface, such as the wall of a high temperature furnace, including an elongated stud which can be attached at one end to the wall such as by welding or the use of a bolt, so that the stud extends perpendicularly from the wall, the stud having an elongated slot intersecting the plane of the stud longitudinal axis, and an elongated tine member slideably receivable in the slot in the stud so that the longitudinal axis of the tine extends substantially parallel the plane of the wall. The ends of the tine are pointed so that blankets of insulation can be impaled on the tine after which the stud and tines hold the insulation to the wall.

8 Claims, 6 Drawing Figures

MODULAR INSULATION ANCHOR

SUMMARY OF THE INVENTION

In the installation and operation of high temperature furnaces it is a common practice to insulate the interior walls of the furnace with blankets of insulation. The insulation may be in the form of blocks or blankets of ceramic fibers.

For background as to the type of insulation employed in furnaces and one method of attaching blanket insulation to furnace walls, reference can be had to U.S. Pat. No. 4,248,023 issued Feb. 3, 1981 and entitled: "Insulated Ceramic Fiber Refractory Module".

Whereas this prior issued patent teaches insulating a furnace wall with a particularly designed module, a current practice employs blocks of insulating material, such as formed of ceramic fibers, the blocks being layed immediately contiguous to each other.

The present invention is directed toward an improved means of supporting insulating blocks to a wall and particularly, to apparatus which greatly facilitates the installation and reduces the time required for installation of insulation blocks.

Briefly stated, the invention includes an elongated stud member having means at one end for attachment to the surface to be insulated. When the surface is a steel wall the stud member can be welded to it. If the wall is of a construction which does not facilitate welding the stud may be in an L-shape form with an opening in the leg portion to receive a bolt so that the stud is held to the wall. The stud, after installation, extends perpendicular to the wall surface. At the outer end of the stud is an elongated slot which is in a plane intersecting the plane of the studs longitudinal axis.

An elongated tine member is slideably received in the slot in the stud member. The tine is sharp on both ends and has means for limiting the slideable position of the tine within the slot in the stud. This can be in the form of integral increased cross-sectional dimensioned portions such formed by punching the tine member adjacent each longitudinal edge. In this way the sliding engagement of the tine member relative to the stud is limited so that approximately 50% of the tine extends to either side of the stud after it is installed in the stud.

A better understanding of the invention will be had with reference to the attached drawings and the detailed description to follow.

DETAILED DESCRIPTION OF THE PREFERRED EMBODIMENT

Figure 1:
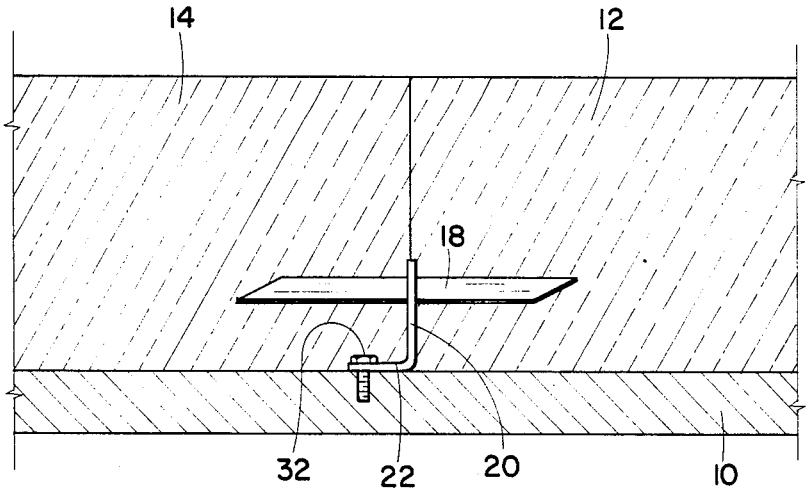
FIG. 1 is a cross-sectional view of a wall (shown horizontally) to be insulated, the wall being such as that of a high temperature furnace or the like, and showing the insulation supporting apparatus of the invention used to support two adjacent blocks or blankets of insulation.

Referring first to FIG. 1, a wall to be insulated is shown in cross-section and identified by the numeral 10. Typically the wall 10 will be vertical, or it may be a ceiling or any other portion of the interior of a furnace or other enclosure which needs to be well insulated. Wall 10 may be of masonry or steel construction. The purpose of the invention is to provide means of supporting blanket insulation on the wall 10. While many types of insulation may be utilized in conjunction with the invention a typical type of blanket insulation is made of ceramic fiber. In FIG. 1 portions of two blocks of insulations 12 and 14 are shown.

Figure 2:
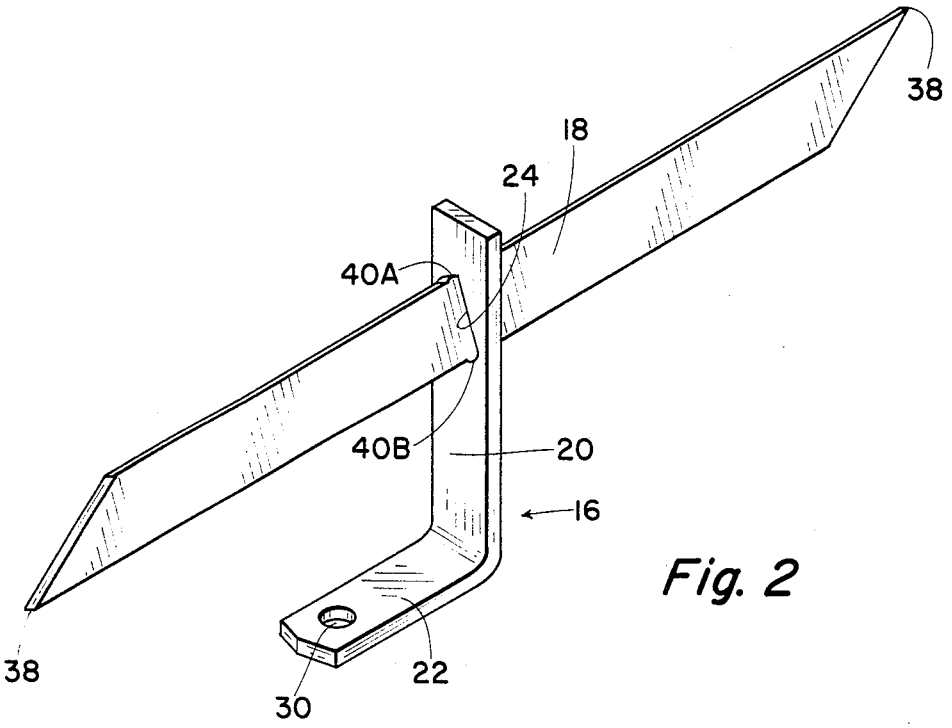
FIG. 2 is a isometric view of the insulation supporting apparatus of the invention of the type in which the stud member is affixed to the wall by means of a bolt.

The apparatus for supporting the insulation is illustrated in isometric view in FIG. 2. The apparatus includes two basic portions, that is, an elongated stud member generally indicated by the numeral 16 and an elongated tine member.

Figure 3:
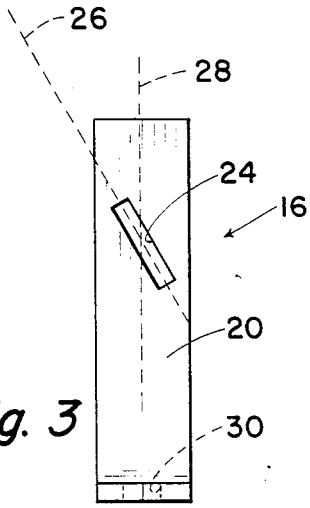
FIG. 3 is a front elevational view of the stud member of the type which is attached with a bolt.
Figure 4:
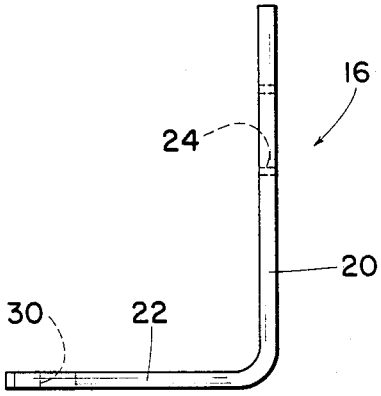
FIG. 4 is a side elevational view of the stud member of FIGS. 2 and 3.

The stud member 16 may be of two basic types. The first type is illustrated in FIGS. 2, 3 and 4 in which the stud member includes a main shank portion 20 and an integral leg portion 22. The shank portion 20 is formed of a flat bar of metal such as steel or, if the application requires, a high melting point alloy. Formed in the shank portion 20 is an elongated slot 24. The slot is oriented so that its longitudinal axis 26 is at an angle relative to the shank portion longitudinal axis 28.

The angle between axis 26 and 28 is preferably between 20° and 60°, with an angle of about 30° being ideal.

The leg portion 22 has a bolt receiving hole 30 so that the stud member may be supported to a wall 10, such as shown in FIG. 1, by means of a bolt 32.

Figure 5:
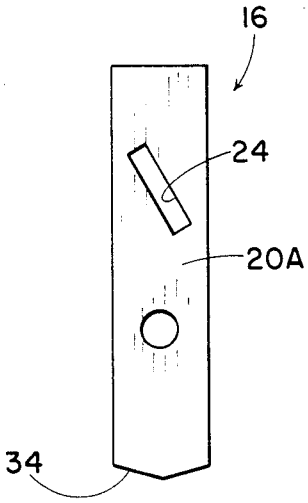
FIGS. 5 and 6 are front and side elevational views respectively of an alternate embodiment of the stud member which is particularly configured for welding to a metal wall.
Figure 6:
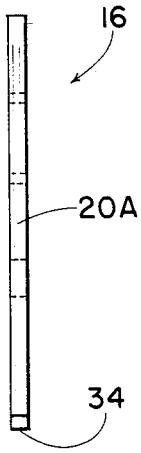

An alternate form of a stud member 16 is shown in FIGS. 5 and 6 which is usable when the wall 10 is of a ferrous material capable of being welded. The shank portion 20A is configured at the inner end 34 to be welded to wall 10. In either arrangement the shank portion 20 or 22A extends substantially perpendicularly from the wall 10 to which it is attached.

Figure 7:
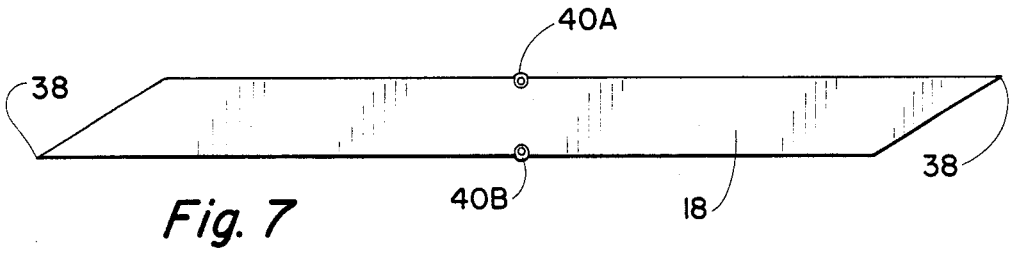
FIGS. 7 and 8 are a top view and side view respectively of the tine member as used in the insulation supporting apparatus.
Figure 8:
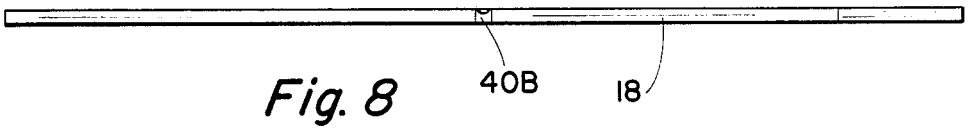

A preferred embodiment of the tine member 18 is shown in FIGS. 7 and 8. It is a elongated flat member pointed at the opposed ends 36 and 38. While the pointed end 38 in the illustrated arrangement is achieved by a single plane it can be seen that two intersecting planes could be employed if desired. The tine 18 is of width and thickness so that it is slideably received in slot 24. In manufacturing the invention the tine 18 and the stud member 16 may be formed of metal stock having the same width and thickness.

The tine is slideably received in slot 24 and in the practice of the invention it is desirable that the tine be inserted into slot 24 approximately half of its length so that it extends in approximately equal lengths to either side of the shank. To facilitate positioning of the tine in the stud member shank an area of increased thickness or width is provided at the center which can be achieved simply and expeditiously by driving a punch adjacent each edge of the tine at the center, the punch causing increased width protusions of 40A and 40B. When these protusions engage the shank portion 20 of the stud as the tine is slid into position they stop further slideable movement and the operator then knows that the tine is correctly positioned.

In using the invention the stud members 16 are attached to the wall to be insulated at spaced intervals, such as a spacing equal to the standard width of the blankets of insulation being employed. If the blankets of insulation are 24 inches wide then the stud members 16 are spaced 24 inches wide. The workman inserts a block of insulation 12 between the adjacent studs. Moving in the direction of placement of the insulation on the wall 10, the workman then inserts a tine 18 which extends within the first block 12 installed, impaling the block of insulation. This leaves the opposite one-half of the tine extending out from the stud. The next block of insulation is slid into position by forcing it against the pointed end of the tine so that it extends within the insulation block. The opposite end of the block is then positioned against the wall adjacent the next stud 20 which does not yet have a tine within it. The workmen then inserts a tine in the next stud and continually repeats the process until the insulation is completely installed.

After the blankets of insulation are installed the stud 16 and tine 18 are substantially insulated by the insulation while at the same time serving to retain the blankets of insulation in position. If it becomes necessary to replace the insulation it can be seen that the tines and stud members can be easily reused and the blocks of insulation removed by reversing the process of installation.

The invention has unique characteristics which may not be readily apparent from first observation. First, the device is extremely economical of manufacture compared with other known devices. This is particularly true since all portions of it may be cut from strips of stock metal of the same width and thickness. Second, the device is exceedingly easy to use. It does not require one piece to be turned or rotated relative to the other but only that the tine be inserted in the slot 24 and extended so that the increased width areas 40A and 40B contact the shank portion 20. Third, the device is exceedingly strong for the amount of material employed. By the angular placement of slot 24 relative to the longitudinal axis of the shank portion 20 the tine 18 is capable of resisting substantial force before it would bend as the force is applied perpendicular to the wall 10. At the same time, by this angle of displacement the tine resists forces parallel to the wall 10. Thus a relatively inexpensive material can be used in a unique way to provide strength which otherwise would require the use of more complex and expensive structural materials.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An insulation supporting apparatus for use in attaching blanket insulation to a surface, comprising:

an elongated stud member having a longitudinal axis and a first end and a second end and having means at the first end for attachment to a surface to be insulated and having an elongated rectangular opening adjacent the second end, the elongated slot having a longitudinal axis, the plane of said longitudinal axis of said elongated slot intersecting the plane of said stud member longitudinal axis at an angle from 20° to 60°; and an elongated tine member having a longitudinal axis and being of rectangular cross-sectional configuration to be slideably and non-rotatably receivable in said rectangular slot in said stud member wherein said longitudinal axis of the tine member extends substantially perpendicular to a plane and said stud member longitudinal axis, at least one end of the tine member being pointed to receive blanket insulation impaled thereon.

2. An insulation supporting apparatus according to claim 1 wherein said stud member is configured at the first end to be welded to a surface.

3. An insulation supporting apparatus according to claim 1 wherein said stud member has an integral L-shaped portion at said first end.

4. An insulation supporting apparatus according to claim 3 wherein said L-shaped portion has a bolt receiving opening therein.

5. An insulation supporting apparatus according to claim 1 wherein said stud member is of rectangular cross-sectional configuration.

6. An insulation supporting apparatus according to claim 1 including means of limiting the slideable position of said tine member in said slot in said stud member.

7. An insulation supporting apparatus according to claim 6 wherein said tine member has an integral increased cross-sectional dimensioned portion forming said means of limiting its slideable position.

8. An insulation supporting apparatus according to claim 6 wherein said tine member is pointed at both ends and said means of limiting its slideable position in said slot in said position in said slot in said stud member is adjacent the center of the length of the tine member.

* * * * *